United States Patent [19]

Kuehn

[11] Patent Number: 4,817,734

[45] Date of Patent: Apr. 4, 1989

[54] SUBMERGIBLE ELECTROHYDRAULIC DRIVE UNIT FOR RAMMING AND WORKING DEVICES TO BE USED UNDER WATER

[75] Inventor: Hans Kuehn, Hamburg, Fed. Rep. of Germany

[73] Assignee: Bomag-Menck GmbH, Boppard, Fed. Rep. of Germany

[21] Appl. No.: 133,904

[22] Filed: Dec. 15, 1987

[30] Foreign Application Priority Data

Jul. 28, 1987 [EP] European Pat. Off. ..... 87110894.0

[51] Int. Cl.[4] ..... E02D 7/06; E02D 7/18

[52] U.S. Cl. ..... 173/29; 173/162.1; 173/DIG. 1; 405/228; 175/6

[58] Field of Search ..... 173/29, 129, 130, 132, 173/134, 162.1, 171, DIG. 1; 405/228; 175/6

[56] References Cited

U.S. PATENT DOCUMENTS 4,043,405 8/1977 Kuhn ..... 173/DIG. 1 X 4,479,550 10/1984 Kuhn et al. ..... 173/DIG. 1 X

*Primary Examiner*—Frank T. Yost

*Assistant Examiner*—James L. Wolfe

*Attorney, Agent, or Firm*—Michael J. Striker

[57] ABSTRACT

A submergible electrohydraulic drive unit is a multipurpose device for driving different underwater ramming and working devices and has a housing with a throughgoing central receiving space for a ramming pile or a respective ramming or working device, ring-shaped upper and lower supporting plates, an outer wall, an inner wall which forms the receiving space, and a plurality of pump units arranged between the inner wall and the outer wall and each having a hydraulic pump and an associated electric motor and individually or jointly limitedly movably spring-biased relative to the housing, one supporting plate having means for exchangeably mounting said device adjusted relative to said receiving space.

43 Claims, 6 Drawing Sheets

Fig. 1
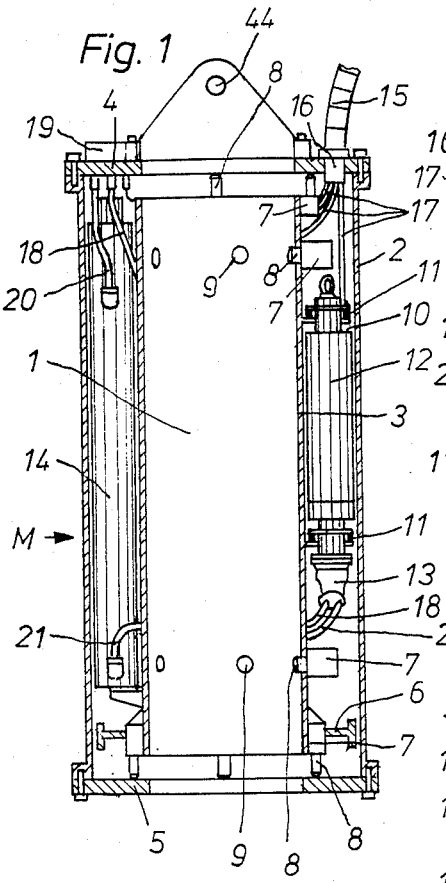
Fig. 3
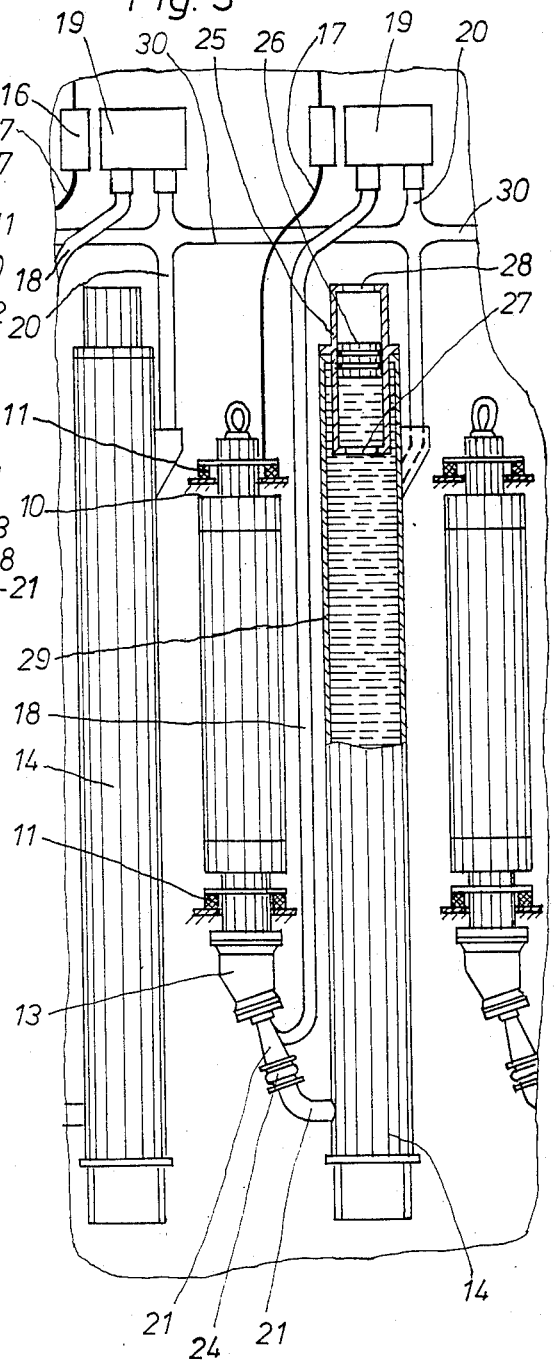
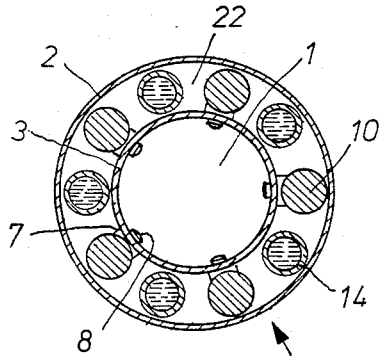
Fig. 2

Fig. 4
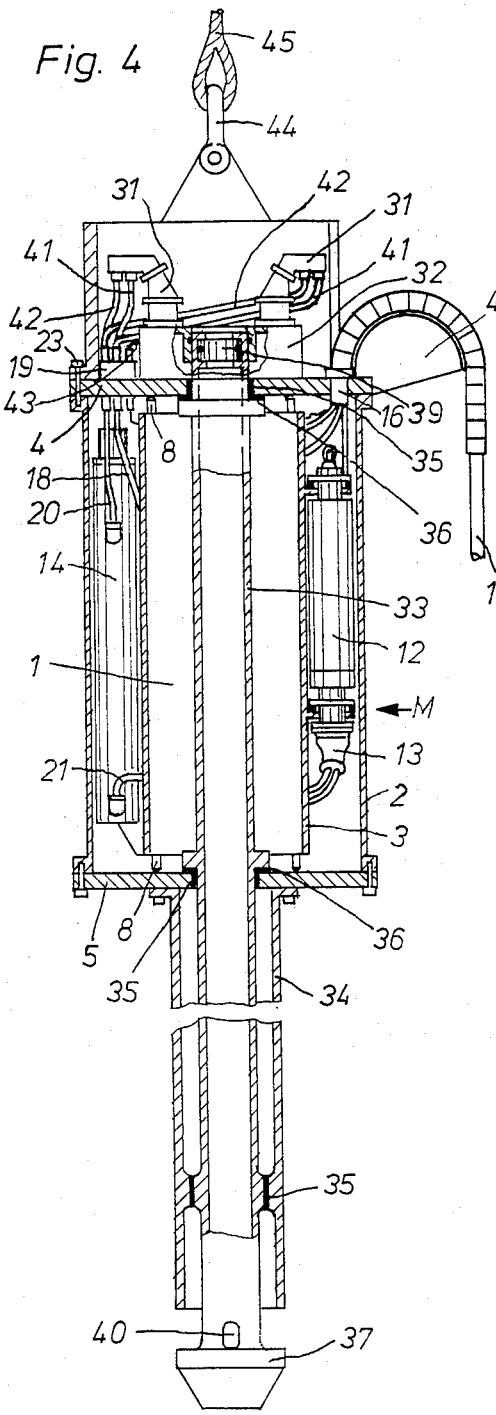
Fig. 5
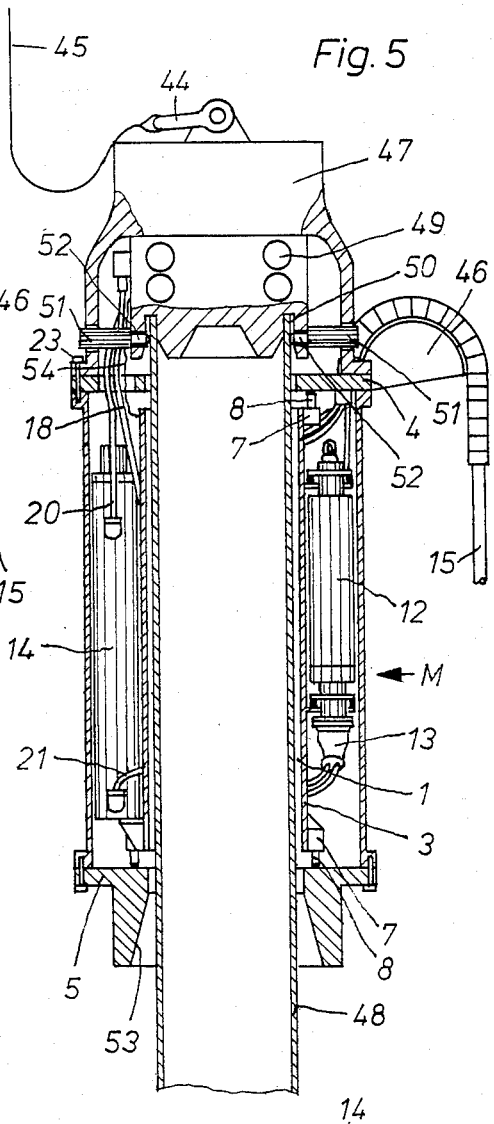
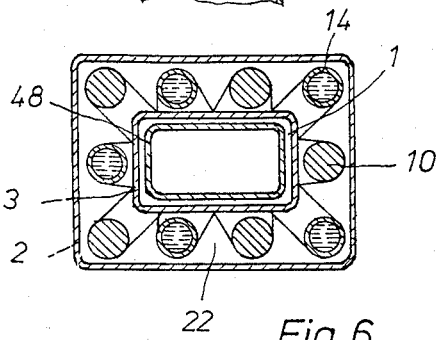
Fig. 6

SUBMERGIBLE ELECTROHYDRAULIC DRIVE UNIT FOR RAMMING AND WORKING DEVICES TO BE USED UNDER WATER

BACKGROUND OF THE INVENTION

The present invention relates to a submergible electrohydraulic drive unit for ramming and working devices to be used under water. More particularly, it relates to such a submergible electrohydraulic drive unit which has hydraulic pumps driveable by electric motors and connected with a pressure medium container, and flexible connecting conduits communicating the hydraulic pumps with a drive of the ramming or working device.

The units of the above mentioned general type are known in the art. U.S. Pat. No. 4,043,405 discloses a ramming arrangement with an impact body slidably guided in a housing, a drive piston connected with the impact body and slidably displaceable in a hydraulic cylinder-piston unit, and a drive unit connected with the hydraulic cylinder-piston unit via pressure medium conduits and a switching device. The drive unit has hydraulic pumps which are driven by an electric motor and a pressure medium container. The drive unit is displaceably upwardly and downwardly guided on the pressure medium cylinder-piston unit arranged on the upper end of the housing, through impact damping means. This known construction is recommended for ramming works under water. However, in this construction it is necessary to provide a shape which exactly corresponds to the upper end portion of the ramming device, and an impact damping displaceable guidance of the whole drive unit on the ramming arrangement.

For excavation of raw deposits located on or under the sea bottom respective underwater arrangements and constructions are to be installed in deep water. For this purpose various working devices must be used in considerable depths. It is always difficult to bring these devices with reasonable time and labor expenses to respective working locations underwater and to drive them with efficient operation. It is in principle possible to construct a special adjusted submergible electrohydraulic drive unit for each individual working device to be used in great water depths, and operate such drive units from a current source located above water through electrical supply conduits which lead to the working device under water with low energy loss, as compared with driving by the hydraulic medium through respective long conduits from a hydraulic pump over water. However, the lowering and subsequent withdrawal of each different device required for an underwater installation and their respective guidance in the working position even in favorable weather conditions requires considerable time and moreover must be performed by means of a respectively great number of underwater drive units adapted to respective working devices. This approach is actually at the limit of the efficiency of operation. This is even more true since the expensive and technically sensitive devices and drive units are formed for performing indispensible but in many times short time special works and then are no longer needed, so that they are stored for long time for the next occasion to use them.

SUMMARY OF THE INVENTION

Accordingly, it is an object of the present invention to provide a submergible electrohydraulic drive unit of the above mentioned general type which has a simple and inexpensive construction and can be used both for ramming devices and also for other underwater working devices in efficient manner, without limiting its utilizability.

In keeping with these objects and with others which will become apparent hereinafter, one feature of the present invention resides, briefly stated, in a submergible hydraulic drive unit which is formed as a multi-purpose unit for driving various ramming and working devices and has a housing with a throughgoing central receiving space for a ramming pile or a required ramming or working device, the housing has ring-shaped upper and lower supporting plates, an outer wall connected with the supporting plates, and an inner wall which defines the receiving space, the device also has a plurality of pump units arranged between the inner and outer walls preferably parallel to the receiving space and each having a hydraulic pump and an associated electric motor, the pump units being limitedly movably biased in a direction parallel to the receiving space relative to the housing individually or jointly, and the upper and/or the lower plate are formed for selective exchangeable mounting of the ramming hammer or working device or a vibration ramming device extending in the receiving space.

The drive unit in accordance with the present invention has a simple robust construction, and because of the arrangement of several or jointly driveable pump units in the housing with a central receiving space, can be used in practically unlimited water depths and in accordance with the respective requirements can be utilized for a ramming hammer, a vibration ramming device, an underwater working device provided with rinsing means, or a rotatable tool holder. The compact design provides for a construction which is favorable and robust especially for rough offshore working conditions, during which the expensive ramming and working devices are protected from all sides against any damage. Because of the advantageously vertical, as well as horizontal elastically spring-biased support of the pump units relative to the housing, the drive unit can also be used for works which are connected with strong shocks or vibrations. The energy transfer from the drive unit to the respective working device can be performed by respective plug connections, whereby a fast exchange of the working device is faciliated.

Because of its specific construction, the drive unit can be placed in a standing condition on the sea bottom or on an underwater structure, or can be suspended from a supporting cable for driving of one or several working devices lowered on separate supporting cables.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a schematic longitudinal section of a drive unit in accordance with the present invention;

FIG. 2 is a view showing a transverse section of the drive unit of FIG. 1;

FIG. 3 is a view showing a drive unit with pressure medium container of the drive unit in accordance with FIG. 1 on a developed view;

FIG. 4 is a schematic longitudinal section of a somewhat different drive unit with built-in working device;

FIG. 5 is a view schematically showing a longitudinal section of the drive unit of FIG. 1 with a built-in vibration ramming device;

FIG. 6 is a view showing a transverse section of the drive unit of FIG. 5;

DESCRIPTION OF THE PREFERRED EMBODIMENTS

Figure 7:
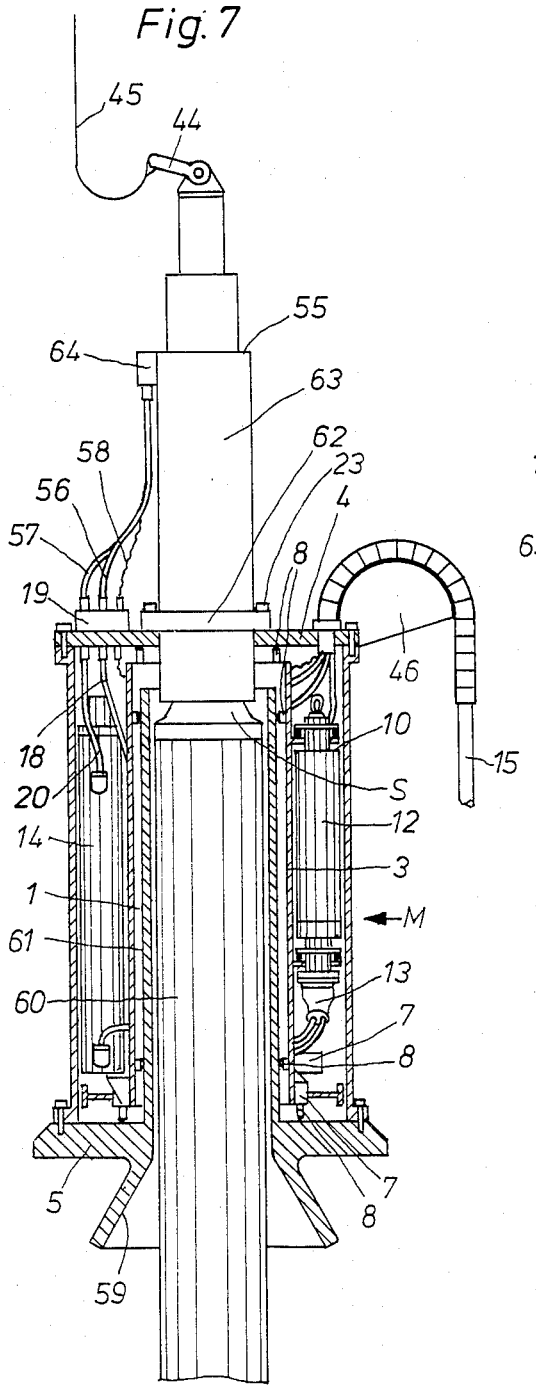
FIG. 7 is a view schematically showing a longitudinal section of a somewhat different drive unit with built-in ramming hammer.

A drive unit shown in FIGS. 1-3 is a substantially cylindrical housing M with a ring-shaped upper supporting plate 4 having a supporting ear 44, a ring-shaped lower supporting plate 5, a cylindrical outer wall 2 connecting the plates 4 and 5 with one another, and a concentric cylindrical inner wall 3 which surrounds a throughgoing receiving space 1. The outer wall 2 is connected with the supporting plates 4 and 5 rigidly by threaded pins 23 which are screwed in threaded openings provided at their ends. The inner wall 3 is provided in its upper and lower portions with throughgoing openings 9 which are distributed over the circumference and centered in the outer wall 2 loosely by ring-shaped centering elements 6. The inner wall is supported in a spring manner in both directions against the upper supporting plate 4 and the lower supporting plate 5 by hydraulic cylinder-piston units 7 which are arranged at the lower end and upper end and provided with outwardly extending pistons 8. The hydraulic cylinder-piston units 7 can accommodate a pretensioned gas or connected with a not shown hydro accumulator. Instead of the hydraulic cylinder-piston unit 7, also a spring cylinder can be provided, which operates under the action of high gas pressure or correspondingly pretensioned elastic element. Further similar hydraulic cylinder-piston units 7 are arranged on the throughgoing openings 9 of the inner wall 3 so that their pistons 8 extend into the receiving space 1 and provide an elastic support of the inner wall 3 against a ramming pile which is inserted in the receiving space 1 or a ramming or working device arranged in it.

In the shown embodiment five pump units 10 arranged at equal circumferential distances from one another are located in an annular chamber 23 formed between the outer wall 2 and the inner wall 3. Each pump unit 10 includes a vertically extending submergible electric motor 12 and a hydraulic pump 13 coaxially connected with the electric motor at its lower end. Each pump unit 10 is supported by elastic supporting elements 11 on a supporting projection of the inner wall 3. A substantially cylindrical pressure medium container 14 also belongs to each pump unit 10. The pressure medium container 14 is located vertically between the neighboring pump units 10 and mounted on the inner wall 3. Each hydraulic pump 13 is connected on the one hand with the lower part of the associated pressure medium container 14 via a connecting conduit 21 with a built-in vibration damping expansion compensator 24. On the other hand, it is connected via a hose-like connecting conduit 18 with a collective connector 19 from which the pressure medium is supplied via not shown further hose connections to the respective ramming or working device to be driven. The return stream of the pressure medium from the ramming or working device is performed also via the collective connector 19 which communicates through a connecting conduit 20 with the upper part of the associated pressure medium container 14.

Since each pump unit 10 has its own longitudinally extending cylindrical pressure medium container 14, simultaneously an effective cooling of the pressure medium by the surrounding water is achieved. The electric motors 12 are connected by a special electrical conductor 17 with a water-tight connection box 16. An umbilical cable 15 which extends from an energy source through water and provided with a number of separate electric power conduits which at least correspond to the number of the electrical motors 12 is water-tightly connected with the connection box 16. Each pressure medium container 14 is provided on its upper end with a cylinder 25 which on the one hand communicates via an opening 27 with the inner chamber of the pressure medium container 14 and on the other hand communicates via an outer opening 28 with the surrounding area. The cylinder 25 is provided with a displaceable floating piston 26. With this arrangement the pressure in the pressure medium container 14 is always automatically adjusted by the floating piston 26 to the pressure of the surrounding water. Thereby the container wall 29 is not subjected to any overpressure on the one hand, and the pressure medium is uninterruptedly supplied to the hydraulic pump 13 on the other hand. Since the connecting conduits 20 which extend from the collecting connectors 19 to the associated pressure medium containers 14 are connected with one another by a ring conduit 30, therefore in the event of jamming of one floating piston 26 in the respective pressure medium container 14, a pressure equilibrium is still produced by the floating pistons 26 of the remaining pressure medium containers, so that the device always remains operative.

In operation pressure medium is aspirated by the hydraulic pump 13 via the connecting conduit 21 from the pressure medium container 14 and supplied via the hose conduit 18 and the collecting connection 19 to the ramming or working device to be driven, while the return pressure medium is withdrawn from the collective connector 19 via the connecting conduit 20 to the pressure medium container 14.

Since the pump units 10 and the pressure medium containers 14 are uniformly distributed over the periphery of the cylindrical housing M, the drive unit is not subjected during its connection with a ramming or working device to any weight-related canting.

The drive unit shown in FIG. 4 is formed in correspondence with FIG. 1 and carries a working device which is releasably connected with the upper supporting plate 4 by threaded pins 23 and provided with a working spindle 33 which is driven by hydraulic motors 31 and a transmission 32. The working spindle 33 extends coaxially through the receiving space 1 and a guiding pipe 34 which is concentrically arranged on the lower supporting plate 5. The working spindle 33 is connected at its lower end with an exchangeable tool holder 37 for joint rotation therewith. The working spindle 33 is rotatably supported by a radial bearings 35 arranged in the supporting plates 4 and 5 and in the guiding pipe 34. In addition, it is secured from vertical displacement by an axial bearing 36 cooperating with the supporting plates 4 and 5.

The hydraulic motors 31 are driven by the pressure medium supplied by the hydraulic pumps 13 through the hose conduit 18, the collective connector 19 and a connecting conduit 41. Then it flows back through the connecting conduit 42, the collective connector 19 and the connecting conduit 20 to the pressure medium container 14. In addition, the working device is supplied with current through the connecting box 16 connected with the umbilical cable 15 and a supply conduit extending through a connector 43. For supporting the umbilical cable 15, a substantially semi-circular supporting element 46 is arranged on the upper supporting plate 4, so that the hose-shaped hanging umbilical cable 15 lies on the supporting element. The working device connected with the drive unit is suspended by a turnably connected supporting ear 44 on a supporting cable 45 of a not shown working ship and can be lowered together with the drive unit to the desired water depth and again lifted. When needed, the working device connected with the drive unit can also be brought into an inclined position or to a horizontal position, by means of not shown additional devices, for example, an additional supporting element engaging with the guiding pipe 34 or the lower supporting plate 5.

The tool holder 37 arranged on the lower end of the working spindle 33 is provided with known devices for exchangeable holding of not shown working tools for performing cutting, chipping, grinding, sawing and drilling and/or rinsing, pressure jet or flame-cutting operations. When this working tool must be supplied with pressure medium, gases or electric current, they can be supplied through not shown supply conduits which extend in the interior of the hollow spindle 33. They are connected at the upper end through a conventional rotary passage 39 with a pump or respective conduits in the umbilical cable 15, and also through an outlet opening 40 which is adjacent to the tool holder 37 with the working tool to be supplied.

FIGS. 5 and 6 shows the outer wall 2, the inner wall 3 and the receiving space 1 of the drive unit in accordance with a different embodiment, in which they have a rectangular shape. A vibration ramming device 47 is releasably mounted on the upper supporting plate 4 by threaded pins 23. The lower supporting plate 5 is provided with an inlet cone 53 for a substantially rectangular ramming pile 48. In other aspects of the drive unit of this embodiment corresponds to the embodiment of FIGS. 1–3.

The vibration ramming device 47 is provided in a conventional manner with schematically shown unbalance motors 49 and rests on a ramming pile 48 which extends through the receiving space 1. The upper edge of the ramming pile 48 engages into a lower recess 50 of the vibration ramming device 47. For optimal transmission of the vibrations to the ramming pile 48, the vibration ramming device is provided with horizontally extending pressure cylinder-piston units 51. Pistons 52 of these units are pressed in response to pressure medium supply from the drive unit, firmly against the outer wall of the ramming pile 48 and thereby provide for a firm friction connection which is favorable for transmission of the vibrations.

The connecting conduits which are required for pressure medium supply of the pressing cylinder-piston units 51 and lead to at least one hydraulic pump 13 of the drive unit, as well as respective switching elements are not shown in FIG. 1 for the sake of clarity. The signal transmission to vibration ramming device 47 is performed through a signal conduit 54. The vibration ramming device 47 which is connected with the drive unit is lowered through a supporting ear 44 turnably connected at the upper end and through the supporting cable 45 extending through the supporting ear, so that the ramming pile 48 can be guided through an inlet cone 53 into the receiving space 1 until the recess 50 of the vibration ramming device 47 lies on the upper edge of the ramming pile. In operation the vibration ramming device 47 is supplied with pressure medium from the drive unit via the connecting conduits 18 and 20. The pressure medium drives the unbalance motors 49 through respective hydraulic motors in conventional manner for producing a vibration with a frequency and amplitude which is suitable for driving the ramming pile 48.

In the drive unit shown in FIG. 7 the lower supporting plate 5 is provided with an inlet cone 59 which is formed integral there with on the one hand, and is also provided with a guiding pipe 61 for a cylindrical ramming pile 60 and extending upwardly through the receiving space 1 on the other hand. The upper supporting plate 4 is releasably connected with a mounting flange 62 which is arranged on the outer periphery of a hammer housing 63 of a ramming hammer 55 by means of threaded pins. A not shown upwardly and downwardly displaceable impact body is located in a conventional manner in the hammer housing 63 and connected via a piston rod with a piston which is sealingly displaceable in a hydraulic cylinder-piston unit. The chambers of the not shown hydraulic cylinder-piston unit are connected via a not shown switching device, a connector 64, and two hose conduits 56 and 57 with the collective connector 19 of the drive unit. The pressure medium supplied from the hydraulic pump 13 flows via the hose conduit 18, the collective connector 19, and the hose conduit 56 to the connector 64, while the pressure medium which is displaced from the hydraulic cylinder-piston unit flows through the hose conduit 57, the collective connector 19 and the displacing conduit 20 to the pressure medium container 14. The electrical regulation and control signals required for operation of the ramming hammer are transmitted through a signal conduit 58.

In this embodiment the inner wall 3 of the drive unit which supports the pump units 10 and the pressure medium containers 14, is supported in a springy manner above and below b the pistons 8 of the hydraulic cylinder-piston units 7 against the outer surface of the guiding pipe 61. Thereby the pump units 10 and the pressure medium containers 14 are not affected by the ramming impact of the ramming hammer 55. This is true the more as the hammer housing 63 is supported via spring means on the impact plate S which lies on the ramming pile 60, advantageously also through pretensioned spring devices, especially with hydraulic cylinder-piston unit connected with hydro accumulators with outwardly extending supporting pistons.

For driving the ramming pile 60 of a great diameter, the drive unit can be also modified by eliminating the guiding pipe 61. Thereby the pistons 8 of the hydraulic cylinder-piston units 7 abut in a springy manner directly against the ramming pile 60. In both cases the drive unit forms in advantageous manner simultaneously a pile guide which is required for guiding the ramming pile 60.

Figure 8:
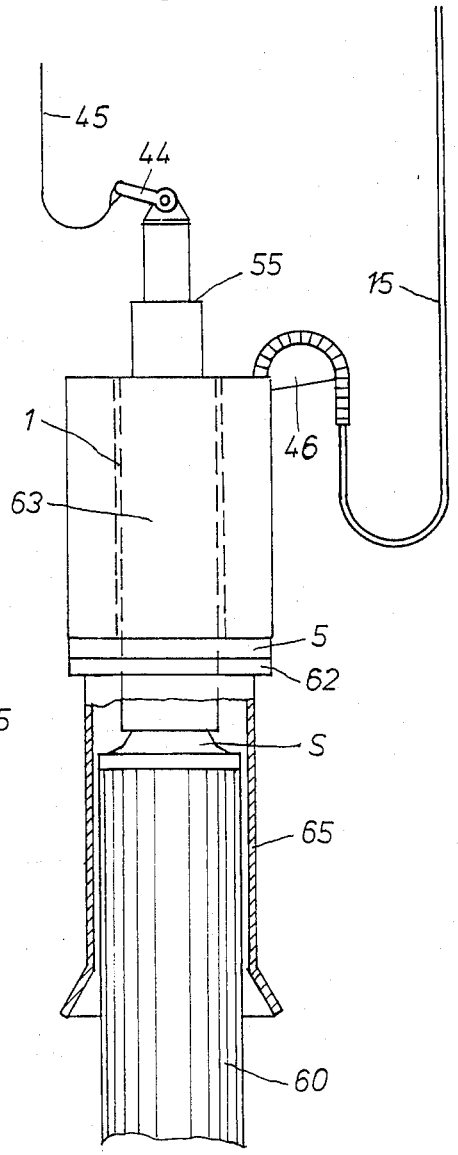
FIG. 8 is a partially sectioned schematic view of a drive unit which surrounds a hammer housing of a ramming hammer.

In the arrangement shown in FIG. 8, the drive unit with the lower supporting plate 5 is lowered from above the periphery of the hammer housing 63 until it reaches an outwardly extending mounting flange 62, wherein the lower supporting plate 5 is advantageously releasably fixed on the mounting flange. Since in this embodiment the drive unit surrounds the main part of the hammer housing 63, in many cases an advantageous small structural length of the arrangement to be lowered is achieved. In the shown embodiment the hammer housing 63 is provided with a pile collar 65 arranged on the lower side of the mounting flange 62 and insuring a reliable free seat on the ramming pile 60. This arrangement also makes possible the driving of a ramming pile 60 with a very large diameter which can no longer be received in the receiving space of the drive unit.

Figure 9:
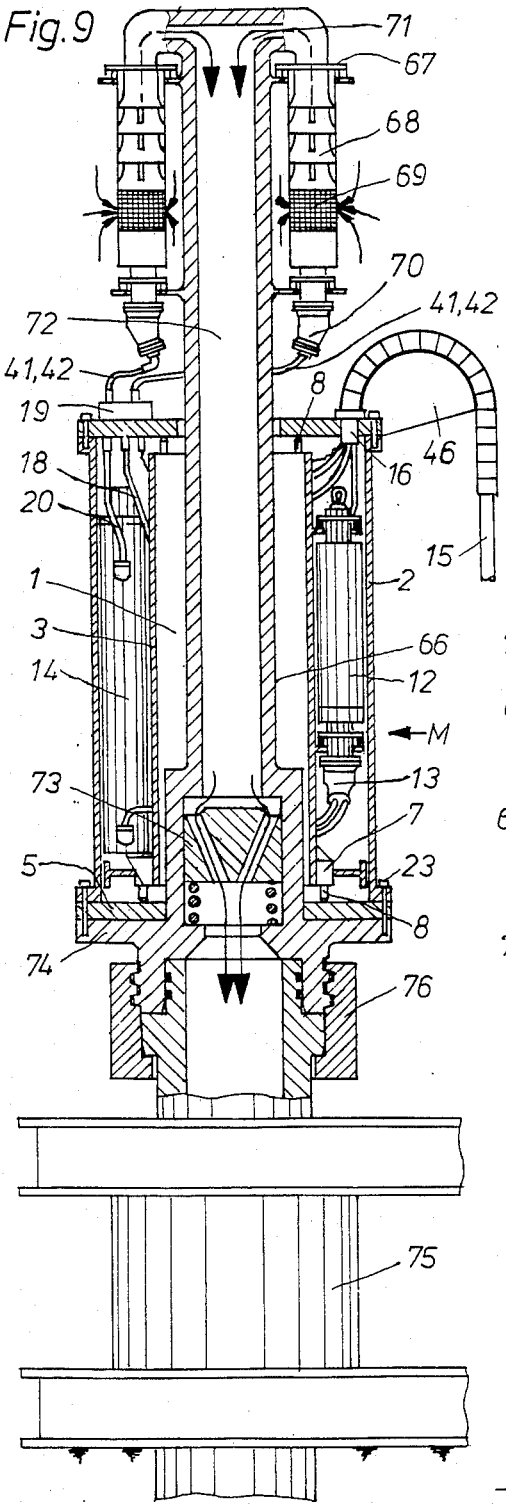
FIG. 9 is a view schematically showing a longitudinal section through a drive unit of FIG. 1 with built-in rinsing device.

In the arrangement shown in FIG. 9 the lower supporting plate 5 is releasably connected by threaded pins 23 with the mounting flange 74 of a rinsing device 66. The rinsing device 66 has a rinsing pipe 72 which extends through the receiving space 1 and has a built-in check valve 73 as well as several pump units 67 arranged at the upper end of the rinsing pipe 72. The pump units 67 include a water pump 68 which is driven by a hydraulic motor 70 and operates for aspirating surrounding sea water through a suction opening 69 and supplying the same through openings 71 into the rinsing pipe 72. In the shown embodiment the rinsing device 67 is fixed in a fluid-tight manner to a lockable oil production device 75 arranged on a sea bottom, by means of the coupling part 76 which operates as a bayonette lock. The hydraulic motors 70 are supplied with pressure medium from the hydraulic pump 13 of the drive unit via the hose conduit 18, the collective connector 19 and the connecting conduit 41. The pressure medium flows back through the connecting conduit 42, the collective connect or 19 and the connecting conduit 20 to the pressure medium container 14. The check valve 73 allows passage of the pressure water stream supplied by the water pump 68 to the oil feeding device 75 and the bore provided under it, but prevents discharging in direction to the rinsing pipe 72.

In this way by means of the universally useable drive unit with the simple rinsing device arranged on it, pressure water can be pressed in efficient manner through an opening in an oil formation, so that unrecoverable oil can be pressed out at another location making the oil formation more productive. A substantial advantage is that the utilization of a damage-susceptible, expensive, long high-pressure hose of large diameter from the ship to the opening can be dispensed with. This advantage becomes even more important with higher required water pressure and greater water depth.

Figure 11:
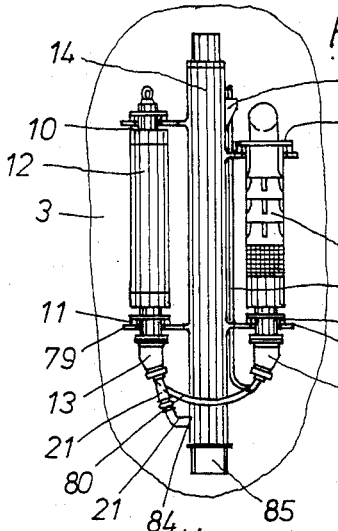
FIG. 11 is a view showing a pump unit of the drive unit of FIG. 10 in developed view.
Figure 10:
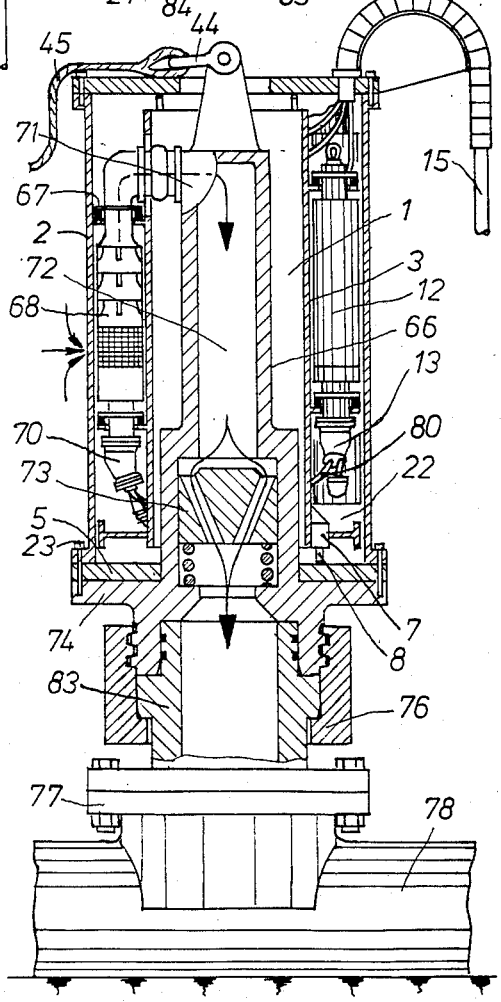
FIG. 10 is a schematic longitudinal section through a different drive unit for built-in rinsing device.

In the embodiments shown in FIGS. 10 and 11, the drive unit is provided in the annular chamber 22 between the outer wall 2 and the inner wall 3 with built-in pump units 67. A hydraulic motor 70 connected with an associated hydraulic pump, and a water pump 68 connected with the hydraulic motor and communicating with the rinsing pipe 72 through an inlet opening 71 in the inner wall 3, are connected with the pump units 67 by respective connecting conduits 80. As a result of this, a very short and compact structure is obtained. In the shown arrangement the rinsing device 66 is connected with a connector pipe 83 by a coupling part 76 which acts as a bayonette lock. The connector pipe 83 is fixed on an inspection flange 77 of a pipe line 78 which lies on the sea bottom. The rinsing device 66 which is connected with the drive unit is lowered and lifted by a supporting ear 44 turnably connected at the upper end and a supporting cable 45 extending through the supporting ear.

In a different embodiment shown in FIG. 11, the pump units 10 and 67 are elastically supported by a elastic supporting elements 11 on supporting pipes 17 which are mounted on the pressure medium containers 14. The pressure medium containers 14 are releasably mounted on a console 85 on the inner wall 3 of the drive unit. In this manner each pressure medium container 14 together with the associated electric motor 12, the hydraulic pump 13 driven by it, the hydraulic motor 17 and the water pump 68 driven by it can be fast and simply inserted in and removed from the annular chamber 22 which becomes accessible after removal of releasable segments of the outer wall 2. The pressure medium which is supplied by the hydraulic pumps 13 via the connecting conduit 8 to the hydraulic motor 70 flows back via a connecting conduit 81 to the connector 82 of the pressure medium container 14. The pressure medium is aspirated from the pressure medium container 14 by the hydraulic pump 13 through a connector 84 and the connecting conduit 21.

Figure 12:
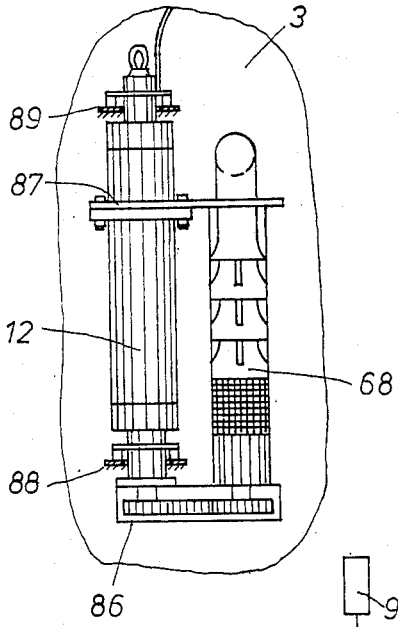
FIG. 12 is a view showing another embodiment of a pump unit of the drive unit of FIG. 10.

In the different embodiment shown in FIG. 12, the electric motor 12 mounted on the inner wall 3 by supporting elements 88 and 89 drives the water pump 68 connected with it by a support plate 87, directly through a transmission 86.

Figure 13:
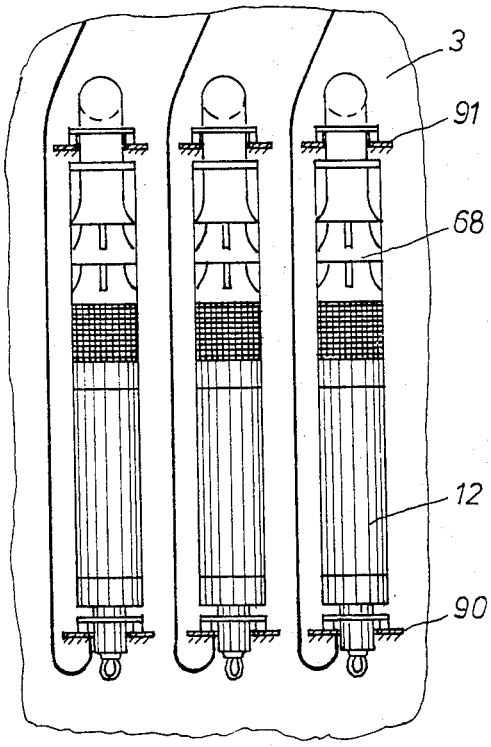
FIG. 13 is a view showing a further different construction of the pump units of a drive unit of FIG. 10.

In the embodiment shown in FIG. 13 the water pump 68 and the electric motor 12 are connected coaxially to form a unit which is mounted by supporting plates 90 and 91 on the inner wall 3. This embodiment is suitable for cases when a direct drive of the water pump 68 without changing of rotary speed ratio is permissible.

It is to be understood that the embodiments shown in FIGS. 1–13 can be modified in accordance with the requirements of their use in many aspects, so that with the utilization of a complete drive unit a maximum universal applicability of the drive unit for different devices can be provided by means of exchangeable modular construction of the ramming and drive devices required for respective applications with few mounting parts and snap connections, or also by certain modifications of individual parts. In connection with this the drive unit can be designed so that in the position on the sea bottom, or an underwater structure, or suspended on a supporting element it drives a ramming or working device lowerable on its own supporting element through several connecting conduits.

Figure 14:
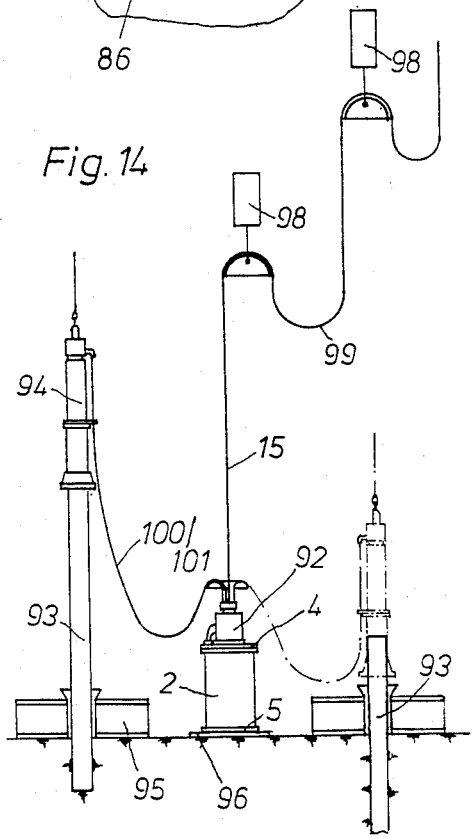
FIG. 14 is a schematic view of the drive of a ramming device through a drive unit lowered to the sea bottom.
Figure 15:
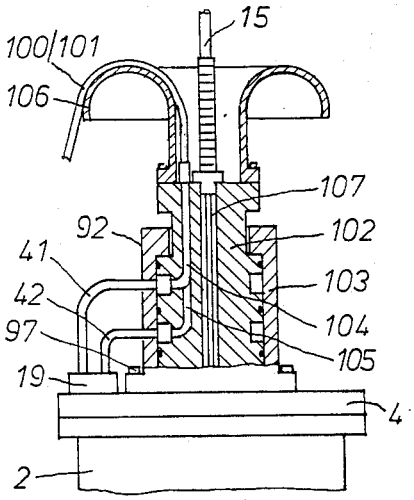
FIG. 15 is a partial longitudinal section through the rotary head of the drive unit of FIG. 14.

The drive unit which is shown in FIGS. 14 and 15 can be placed on the sea bottom and is provided with a base plate 96 mounted optionally on the lower supporting plate 5 for increasing its stability on the one hand, and with a rotary head 92 which is releasably connected with the upper supporting plate 4 by threaded pins 97 on the other hand. The rotary head 92 has a rotary pin 102 which is rotatably supported in a housing 103 and is provided with a central throughgoing passage 107 for the umbilical cable 15 and two throughgoing passages 104 and 105. The throughgoing passages 104 and 105 lead respectively to a ring-shaped groove which is formed on the peripheral surface of the rotary head 102 and communicates through it independently of the rotary position of the rotary head 102 with an associated connecting conduit 41 and 42. On the other end they are connected respectively with an associated longer connecting hose 100 or 101. The connecting hoses 100 and 101 are guided over a torus-shaped curved supporting surface of a ring-shaped collar 106, for preventing buckling. Since the rotary head 92 is freely rotatable over 360°, the hose conduits 100 and 101 can extend without difficulties to a ramming hammer 94. The ramming hammer sits free-riding on a pile 93 preinstalled in a guiding device 95 in a larger lateral distance from the drive unit. The umbilical cable 15 is supported by several buoyancy containers 98. The buoyancy of the lowest buoyancy container 98 is selected so that a part of the umbilical cable 15 is maintained vertically over the drive unit, while the remaining buoyancy containers 98 lead the umbilical cable 15 with formation of hanging loops 99 in a stepped manner to the water surface.

In this way several ramming piles 93 which are preinstalled in the vicinity of the drive unit lowered on the sea bottom can be driven one after the other with the same ramming hammer 94, without displacing the drive unit. In the arrangement shown in FIG. 14, first the right ramming pile 93 is rammed-in, and the ramming hammer 94 is then moved to the left pre-installed ramming pile 93. Thereby for example several ramming piles which are pre-installed on an offshore platform can be driven in time and labor saving manner.

Figure 16:
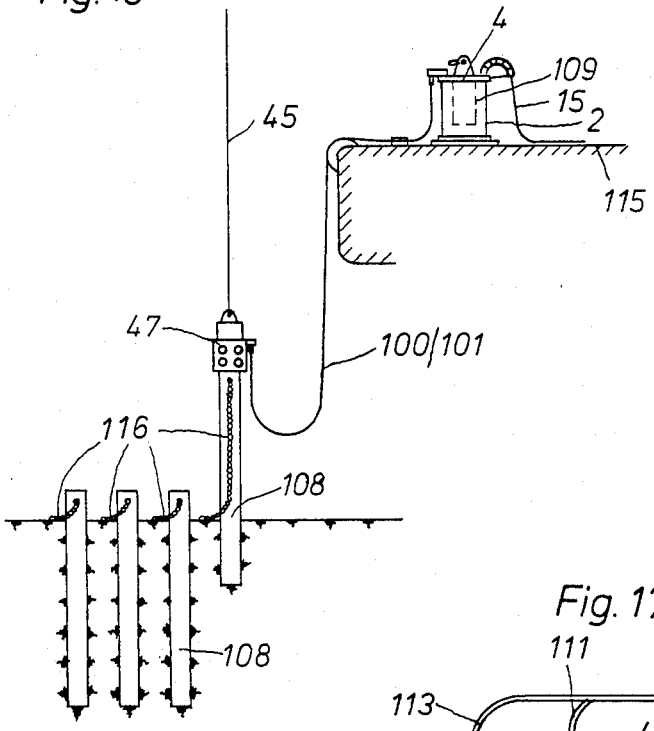
FIG. 16 is a schematic view of a drive unit which is arranged on an underwater structure and provided with an additional pressure medium container.
Figure 17:
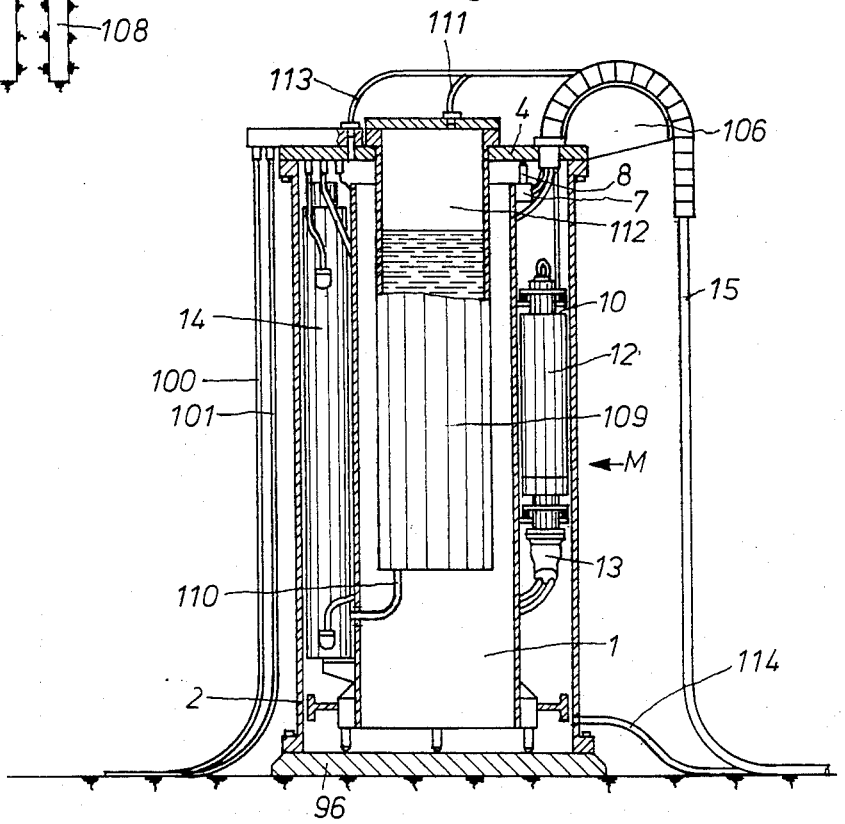
FIG. 17 is a schematic longitudinal section through a drive unit of FIGS. 1 and 16 with built-in additional pressure medium container.

In the embodiments shown in FIG. 16, the drive unit is arranged on an underwater structure 115 or on a ship deck over water. It is connected with a hydraulically driven vibration ramming device 47 through long hose conduits 100 and 101. A greater number of anchor piles 108 with anchor chains 116 mounted thereon for holding a not shown underwater structure in the sea bottom can be rammed-in with the vibration ramming device 47. The drive unit is supplied with required electrical energy through the umbilical cable 15. Since longer hose conduits 100 and 101 which lead from the drive unit to the vibration ramming device 47 receive a pressure medium filling quantity which is dependent on their diameter, the pressure medium quantity which remains in the pressure medium container 14 can be so low that the supply of the hydraulic pumps 13 with the pressure medium is no longer ensured. For avoiding this, the drive unit is provided as shown in FIG. 17 with an additional pressure medium container 109 which is inserted in the receiving space 1. This additional pressure medium container 109 is held on the upper supporting plate 4 and communicates via a connecting conduit 110 with the pressure medium containers 14. Since the drive unit is no longer placed under water but instead is installed on a ship deck, the floating piston 26 and the cylinder 25 is no longer pressed strongly against the pressure medium in the pressure medium container 14 because of the lack of water pressure acting on its outer surface and the friction of its seal. Despite the fact that the pressure medium must always reliably flow through the hose conduit 100 because of the high pressure differential between the drive unit and the working device located at a large depth, a short time interruption of the pressure medium supply still can take place during oscillating operation. This can be damaging for the hydraulic motors over certain time. For this reason, the drive unit for the use under water is provided with an air conduit 111 which extends parallel to the umbilical cable 15 through the supporting element 106 to the upper side of the additional pressure medium container 109 for obtaining by small overpressure a pretensioning which urges the supply. A pressure air chamber 112 which is formed by withdrawal of pressure medium in the additional pressure medium container 109 serves simultaneously as a buffer chamber. During oscillating operation it receives discontinuously flowing back pressure medium quantities through the hose conduit 100 without undesirable pressure peaks.

For providing cooling of the electric motors 12 and the hydraulic pumps 13 by surrounding water also in the case when the drive unit is placed above water, a cooling water conduit 113 is introduced into the inner chamber of the drive unit, which is limited by the outer wall 2 sealingly connected with the base plate 96. The cooling water is then discharged from the inner chamber through a discharge conduit 114. In this manner the pump units 10 and the hydraulic oil in the pressure medium containers 14 and 109 are also cooled, as during the use of the arrangement under water.

The embodiments of the drive unit which are described hereinabove can naturally be modified by an expert in the field so as to suit the requirements of each individual application, as long as it is designed as multiple-purpose drive unit for different selectively installed ramming or working devices and is provided with a housing with a central receiving space and ring-shaped upper and lower supporting plates for mounting the respective device, as well as pump units and pressure medium containers arranged between the receiving space and an outer wall in a springy fashion.

It will be understood that each of the elements described above, or two or more together, may also find a useful application in other types of constructions differing from the types described above.

While the invention has been illustrated and described as embodied in a submergible electric hydraulic drive unit for ramming and working devices designed for underwater usage, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A submergible electrohydraulic drive unit for working devices for use under water, comprising a housing having upper and lower supporting plates, an outer wall connected with said supporting plates, and an inner wall forming a thoroughgoing receiving space for at least one exchangeable device selected from a pile driver hammer, a vibration ramming device, a rotatable working device or a rinsing device; and a plurality of pump units connectable with the device and including a plurality of hydraulic pumps and associated electric motors, arranged between said inner wall and said outer wall at circumferential distances from each other, so that the drive unit is formed as a multi-purpose unit for driving the respective one of said devices, said pump units being mounted for limited movement against pre-tensioned spring force relative to said housing, and at least one of said plates being provided with means for exchangeably mounting said device in opposition adjusted relative to said receiving space.

2. A submergible electrohydraulic drive unit as defined in claim 1 for ramming and working devices having a drive; and further comprising a plurality of flexible connecting conduits arranged to connect said hydraulic pumps with the drive of a respective one of the devices.

3. A submergible electrohydraulic drive unit as defined in claim 1, wherein said supporting plates of said housing are formed as ring-shaped plates.

4. A submergible electrohydraulic drive unit as defined in claim 1, wherein said pump units are arranged between said inner wall and said outer wall parallel to said receiving space.

5. A submergible electrohydraulic drive unit as defined in claim 1, wherein said pump units are individually spring biased in a direction parallel to said receiving space.

6. A submergible electrohydraulic drive unit as defined in claim 1, wherein said pump units are jointly spring biased in a direction parallel to said receiving space.

7. A submergible electrohydraulic drive unit as defined in claim 1, wherein said pump units are fixedly connected with said inner wall of said housing and said inner wall is spring biased in two opposite directions relative to said upper and lower supporting plates.

8. A submergible electrohydraulic drive unit as defined in claim 1, wherein said pump units are elastically supported on said inner wall of said housing and said inner wall is spring biased in two opposite directions relative to said upper and lower supporting plates.

9. A submergible electrohydraulic drive unit as defined in claim 1; and further comprising pre-tensioned spring means arranged to spring-bias said pump units.

10. A submergible electrohydraulic drive unit as defined in claim 9, wherein said pre-tensioned spring means include a hydraulic cylinder-piston unit provided with a piston and connected with a pre-tensioned hydro accumulator.

11. A submergible electrohydraulic drive unit as defined in claim 1; and further comprising centering means arranged to limitedly displaceably guide said inner wall in said outer wall of said housing; and spring means arranged at circumferential distances from one another for springy supporting against a device received in said receiving space.

12. A submergible electrohydraulic drive unit as defined in claim 11, wherein said spring means includes a plurality of pre-tensioned hydraulic cylinder-piston units provided with radially inwardly extending pistons for springy supporting against said device.

13. A submergible electrohydraulic drive unit as defined in claim 1, wherein said electric motors have a longitudinal axis; and further comprising substantially cylindrical pressure medium containers connected with said hydraulic pumps and arranged coaxially to said longitudinal axis of said electric motors.

14. A submergible electrohydraulic drive unit as defined in claim 1, wherein said electric motors have a longitudinal axis; and further comprising substantially cylindrical pressure medium containers connected with said hydraulic pumps and arranged parallel to said longitudinal axis of said electric motors.

15. A submergible electrohydraulic drive unit as defined in claim 1; and further comprising pressure medium containers connected with said hydraulic pumps, said pump units and said pressure medium containers being arranged between said outer wall and said inner wall of said housing alternatingly near one another in a circumferential direction.

16. A submergible electrohydraulic drive unit as defined in claim 1, wherein said outer wall and said inner wall of said housing are arranged concentrically with one another and have substantially cylindrical shape.

17. A submergible electrohydraulic drive unit as defined in claim 1, wherein said outer wall of said housing is completely removable from said housing.

18. A submergible electrohydraulic drive unit as defined in claim 1, wherein said outer wall of said housing is at least partially removable from said housing.

19. A submergible electrohydraulic drive unit as defined in claim 1, wherein said upper and lower supporting plates are formed exchangeably with one another.

20. A submergible electrohydraulic drive unit as defined in claim 1; and further comprising means for driving individually said pump units and including a watertight connector box, a plurality of separate electrical conduits connecting said pump units with said connector box to which there can be connected an umbilical cable provided with a plurality of separate electric conduits.

21. A submergible electrohydraulic drive unit as defined in claim 1; and further comprising a plurality of pressure medium containers connected with said hydraulic pumps, said pressure medium containers being in communication with one another and having an inner chamber provided with pressure equalizing opening communicating with an outer space and closed by a floating piston for automatic adjusting of pressure of said pressure medium containers to an outside pressure.

22. A submergible electrohydraulic drive unit as defined in claim 1; and further comprising a plurality of pressure medium containers connected with said hydraulic pumps, said pressure medium containers being in communication with one another and having an inner chamber provided with pressure equalizing opening communicating with an outer space and closed by a flexible separating wall for automatic adjusting of pressure of said pressure medium containers to an outside pressure.

23. A submergible electrohydraulic drive unit as defined in claim 1; and further comprising a pile guiding pipe being supported on said lower supporting plate and surrounded by said inner wall of the housing, said inner wall of said housing being springy supported on a periphery of said guiding pipe, said pile guiding pipe being adapted for guiding a ramming pile.

24. A submergible electrohydraulic drive unit as defined in claim 1, wherein said is a ramming hammer provided with a hammer housing having a projection, said receiving space has an inner dimension formed for guiding the hammer housing of the ramming hammer, at least one of said supporting plates being formed for springy supporting said projection of the hammer housing.

25. A submergible electrohydraulic drive unit as defined in claim 1, wherein said device is a ramming hammer provided with a hammer housing having a projection, said receiving space has an inner dimension formed for guiding the hammer housing of the ramming hammer, at least one of said supporting plates being formed for releasably mounting said projection of the hammer housing.

26. A submergible electrohydraulic drive unit as defined in claim 1, wherein said device is a working spindle which is rotatably supportable in said supporting plates has an end projecting outwardly beyond said receiving space and carrying a tool holder; and further comprising a hydraulic motor connected with said pump unit and arranged to drive the working spindle in rotation, said upper supporting plate being formed for releasable mounting the device with said hydraulic motor.

27. A submergible electrohydraulic drive unit as defined in claim 26; and further comprising means for supplying the tool holder with working medium and including a rotary passage, a channel in the working spindle, and at least one supply conduit extending from one of said hydraulic pumps through said rotary passage and said channel in the working spindle to the tool holder.

28. A submergible electrohydraulic drive unit as defined in claim 26; and further comprising a guiding pipe arranged releasably on said lower supporting plate and projecting downwardly coaxially to said receiving space and provided with at least one rotary bearing for the working spindle.

29. A submergible electrohydraulic drive unit as defined in claim 1, wherein said device is a vibration ramming device adapted to be connected in a force-transmitting manner with a ramming pile to be inserted into receiving space said upper supporting plate being formed for releasably mounting said vibration ramming device.

30. A submergible electrohydraulic drive unit as defined in claim 1, wherein the device is rinsing device; adapted to be releasably mounted on one of said supporting plate and provided with a hydraulic motor connectable with said drive units, at least one water pump driveable by said hydraulic motor, a rinsing pipe extending through said receiving space and connected with a pressure side of said water pump, and a coupling part connected with said rinsing pipe for releasably mounting on an underwater device to be rinsed.

31. A submergible electrohydraulic drive unit as defined in claim 30, wherein said water pump is arranged between said inner wall and said outer wall of said housing and associated with at least one of said pump units; and further comprising connecting conduits communicating said hydraulic motor with one of said pump units.

32. A submergible electrohydraulic drive unit as defined in claim 30, wherein the device is a rinsing device; adapted to be releasably mounted on at least one of said supporting plate and provided with a an electric motor, at least one water pump driveable by said hydraulic motor, a rinsing pipe extending through said receiving space and connected with a pressure side of said water pump, and a coupling part connected with said rinsing pipe for releasably mounting on an underwater device to be rinsed.

33. A submergible electrohydraulic drive unit as defined in claim 32; and further comprising a transmission through which said water pump is driven by said electric motor.

34. A submergible electrohydraulic drive unit as defined in claim 1; and further comprising a pressure medium container connected with said hydraulic pumps, and an additional pressure medium container connected with said pressure medium container and extending in said receiving space, said upper supporting plate being formed for releasably mounting of said additional pressure medium container.

35. A submergible electrohydraulic drive unit as defined in claim 1; and further comprising means for supplying pressure medium from said pump units to the device and including a plurality of connecting conduits, a rotary head communicating with said connecting conduits and selectively mounted on said upper supporting plate, and guiding means provided on said rotary head for guiding communicating conduits to said device.

36. A submergible electrohydraulic drive unit as defined in claim 1, wherein said upper supporting plate is provided with means for suspendingly mounting on a flexible supporting element.

37. A submergible electrohydraulic drive unit as defined in claim 1, wherein the device has a hydraulic drive element; and further comprising pressure medium containers connected with said hydraulic pumps and means for connecting said hydraulic pumps and said pressure medium containers with the hydraulic drive element of the device and including a collecting connector, a plurality of flexible connecting conduits which connect said hydraulic pumps with said pressure medium containers with said collecting connector, and releasable hose conduits connecting said collecting connector with the hydraulic element of the device.

38. A submergible electrohydraulic drive unit as defined in claim 1 for several such devices; and further comprising switching means for supplying and distributing a pressure medium stream produced by said hydraulic pumps, and associated hose conduits connecting said switching means with the devices.

39. A submergible electrohydraulic drive unit as defined in claim 38, wherein said switching means is formed for supplying volume-adjustable pressure medium partial streams to the devices.

40. A submergible electrohydraulic drive unit as defined in claim 1, wherein said housing further comprises a buoyancy container for receiving gas.

41. A submergible electrohydraulic drive unit as defined in claim 1, wherein said housing further comprises a guiding wall for the ramming part downwardly projecting from said lower supporting plate, and including a buoyancy container for receiving gas.

42. A submergible electrohydraulic drive unit as defined in claim 1; and further comprising at least one positioning element with a driveable propeller for producing a substantially horizontal thrust stream.

43. A submergible electrohydraulic drive unit as defined in claim 1; and further comprising means for producing a substantially horizontal thrust stream.

* * * * *